US010946991B2

(12) United States Patent
Dersch

(10) Patent No.: US 10,946,991 B2
(45) Date of Patent: Mar. 16, 2021

(54) METHOD FOR OPERATING A TUBULAR BAG MACHINE FOR PRODUCING BAGS HAVING A TRANSVERSE BOTTOM SEAM AND A TRANSVERSE TOP SEAM DIFFERENT TO THE TRANSVERSE BOTTOM SEAM

(71) Applicant: ROVEMA GMBH, Fernwald (DE)

(72) Inventor: Volker Dersch, Gruenberg (DE)

(73) Assignee: ROVEMA GMBH, Fernwald (DE)

( * ) Notice: Subject to any disclaimer, the term of this patent is extended or adjusted under 35 U.S.C. 154(b) by 211 days.

(21) Appl. No.: 16/316,363

(22) PCT Filed: Jul. 11, 2017

(86) PCT No.: PCT/EP2017/067420
§ 371 (c)(1),
(2) Date: Jan. 9, 2019

(87) PCT Pub. No.: WO2018/015217
PCT Pub. Date: Jan. 25, 2018

(65) Prior Publication Data

US 2019/0248520 A1 Aug. 15, 2019

(30) Foreign Application Priority Data

Jul. 18, 2016 (DE) ..... 10 2016 213 087

(51) Int. Cl.
*B65B 9/20* (2012.01)
*B65B 9/213* (2012.01)

(52) U.S. Cl.
CPC ..... *B65B 9/2042* (2013.01); *B65B 9/20* (2013.01); *B65B 9/213* (2013.01)

(58) Field of Classification Search
CPC ..... B65B 9/20; B65B 9/2014; B65B 9/2021; B65B 9/2028; B65B 9/2042; B65B 9/213; B65B 51/30; B65B 51/3036; B65B 61/188
(Continued)

(56) References Cited

U.S. PATENT DOCUMENTS 5,822,949 A * 10/1998 Naoi ..... B65B 9/213 53/55
6,131,369 A * 10/2000 Ausnit ..... B65B 9/20 493/213
(Continued)

FOREIGN PATENT DOCUMENTS

DE 880302 C 7/1988
DE 19858567 A1 6/2000
(Continued)

*Primary Examiner* — Hemant Desai
*Assistant Examiner* — Christopher Robin Kim
(74) *Attorney, Agent, or Firm* — King & Schickli, PLLC

(57) ABSTRACT

A method for operating a tubular bag machine having a biaxially drivable transverse sealing device for producing tubular bags, a film sheet being closed by transverse bottom and top seams after having formed a film tube, an edge area of the film sheet forming a side fold using a side folder before forming the transverse bottom seam, and transverse top and bottom seams formed by adjacent tubular bags in one work step, said tubular bags formed in the draw direction having an alternating orientation, said side folder interacting with a stationary fold molding on the inner side of the film sheet, the minimal distance of the transverse sealing device to the fold molding alternatingly altered in the draw direction and being larger when producing the two transverse top seams than the minimal distance of the transverse sealing device to the fold molding when producing the transverse bottom seams.

6 Claims, 4 Drawing Sheets

(58) Field of Classification Search
USPC ..... 53/412, 133.4, 139.2, 451, 551, 552
See application file for complete search history.

(56) References Cited

U.S. PATENT DOCUMENTS 6,463,720 B1 * 10/2002 Cherney ..... B65B 1/22 53/437
6,505,664 B1 * 1/2003 Blundell ..... B29C 65/18 156/515
6,877,295 B1 * 4/2005 Benedetti ..... B29C 66/83543 53/451
2003/0163979 A1 * 9/2003 Kurth ..... B65B 9/22 53/551
2004/0058103 A1 3/2004 Anderson et al.
2005/0210840 A1 * 9/2005 Kohl ..... B65B 9/2042 53/551
2006/0064947 A1 * 3/2006 Bartel ..... B65B 9/22 53/551
2007/0084142 A1 * 4/2007 Matthews ..... B65B 61/188 53/412
2007/0163214 A1 * 7/2007 Hauers ..... B65B 9/2049 53/551
2008/0041023 A1 * 2/2008 Tsuruta ..... B29C 66/8181 53/548
2018/0141283 A1 * 5/2018 Masek ..... B65B 51/30
2018/0237173 A1 * 8/2018 Bierschenk ..... B65B 9/2007
2019/0002174 A1 * 1/2019 Lyzenga ..... B65B 9/026
2019/0241297 A1 * 8/2019 Brenkus ..... B29C 66/4312
2019/0337651 A1 * 11/2019 Otxoa-Aizpurua Calvo ..... B65B 9/2042
2020/0207499 A1 * 7/2020 Koike ..... B65B 9/213

FOREIGN PATENT DOCUMENTS

DE 10013139 A1 9/2001
EP 2508435 A1 10/2012
WO WO2015144100 A1 10/2015

* cited by examiner

METHOD FOR OPERATING A TUBULAR BAG MACHINE FOR PRODUCING BAGS HAVING A TRANSVERSE BOTTOM SEAM AND A TRANSVERSE TOP SEAM DIFFERENT TO THE TRANSVERSE BOTTOM SEAM

BACKGROUND OF THE INVENTION

The invention relates to a method for operating a tubular bag machine for producing bags having a transverse bottom seam and transverse top seam different to the transverse bottom seam according to the preamble of claim 1.

For different packaging tasks in the packaging industry, tubular bags are known in which the transverse bottom seam is formed differently to the transverse top seam. Tubular bags are known, for instance, in which the transverse bottom seam is folded at the side in order to attain a standing surface, for example, whereas the transverse top seam is realized as a simple horizontal transverse seam. The tubular bags differ in regard to their sealing seams at the top and bottom.

SUMMARY OF THE INVENTION

In conventional production methods for producing tubular bags, a transverse top seam and a transverse bottom seam are each produced in each work step by means of the bilaterally drivable transverse sealing jaws via a corresponding film sealing method. The thus produced transverse top and bottom seams divide adjacent tubular bags from each other so that the film has to be severed between the transverse bottom and top seams, which are produced together, by means of a severing device, e.g. a cutting knife, for forming the individual bags.

If tubular bags are to be produced which have a transverse bottom seam differing from the transverse top seam, namely a folded transverse bottom seam, producing a transverse bottom seam and a transverse top seam together is not possible in a single work step of the transverse sealing jaws since the film of the tubular bag has to be folded when producing the transverse bottom seam whereas the production of the transverse top seam prohibits folding the film.

To be able to produce such tubular bags having transverse bottom seams and transverse top seams differing from each other, a production method is known from DE 38 24 753 A1, two transverse bottom seams each being formed by adjacent bags in a first work step of the transverse sealing jaws and two transverse top seams each being formed subsequently thereto in a second work step. In this method, the result is that the individual bags are produced in the draw direction of the tube having an alternating orientation so that adjacent bags are each pre-sealed alternatingly at either the transverse top seam or the transverse bottom seam.

When producing tubular bags having folded transverse bottom seams, the use of so-called side folders is necessary, by means of which the film is folded at the side in the desired manner so as to form a side fold before sealing the transverse bottom seam. The quality of the side fold is vastly improved if the side folder interacts with a stationary fold molding, which is disposed on the inner side, when forming the folded transverse bottom seam. By the side folder interacting with the fold molding, the film is ideally guided in the area of the side fold and can be folded in the desired manner. The use of fold moldings on the inner side of the film sheet when forming the side fold, however, causes significant problems when producing tubular bags having differing transverse seams at the top and bottom—for two transverse bottom seams and then two transverse top seams are produced alternatingly by means of the two transverse sealing jaws in these methods. When sealing the folded transverse bottom seams, it is desirable for the transverse sealing jaws to have a particularly small distance to the fold molding so as to warrant an ideal fold formation. Vice versa, a too small distance of the transverse sealing jaw to the fold molding when sealing the unfolded transverse top seam is exceedingly disadvantageous since undesirable folds can be formed in the unfolded transverse top seam if the distance of the transverse sealing jaws to the inner fold molding is too small. In the known method for operating a tubular bag machine for producing bags having folded transverse bottom seams and unfolded transverse top seams, the use of inner fold moldings has been omitted for this reason though this negatively impacts the folding quality when folding the side fold.

Starting from this state of the art, it is therefore the object of the present invention to propose a new method for operating a tubular bag machine for producing bags having folded transverse bottom seams and unfolded transverse top seams, said new method attaining an ideal folding quality when forming the side fold and effortlessly enabling sealing the unfolded transverse top seam at the same time.

This object is attained by a method according to the teachings of claim 1.

Advantageous embodiments of the invention are the subject matter of the dependent claims.

The method according to the invention is first of all characterized by a fold molding being disposed stationarily on the inner side of the film sheet and interacting with the displaceable side folder when forming the side fold. In order to preclude the undesired fold formation in the area of the transverse top seam which is not to be folded, it is intended according to the invention that the distance of the transverse sealing jaws to the stationary fold molding when forming the transverse top seams is different than when forming the transverse bottom seams. In other words, this means that the transverse sealing jaws are each displaced to a different position along the Z-axis depending on whether two transverse top seams or two transverse bottom seams are sealed using the transverse sealing jaws.

In this context, the minimal distance of the transverse sealing jaws to the stationary fold molding is significantly larger when producing the two transverse top seams than the minimal distance of the transverse sealing jaws to the fold molding when producing the transverse bottom seams.

Via the thus attained additional distance of the transverse sealing jaws to the stationary fold molding while sealing the transverse top seams, the undesired fold formation in the area of the transverse top seams—caused by the fold molding—is largely reduced or entirely prevented. When sealing the transverse bottom seams, however, a smaller minimal distance of the transverse sealing jaws to the fold molding is intended so that the functions of the laterally movable side folder can be ideally supported by the stationary fold molding when folding the film in the area of the transverse bottom seam. In other words, this means that the transverse sealing device moves toward a higher position on its closed biaxial movement trajectory when producing the transverse bottom seams than when producing the transverse top seams, provided the draw direction is oriented vertically downward.

In the method according to the invention, the displacement path of the transverse sealing jaws is altered depending on whether two transverse top seams or two transverse bottom seams are to be sealed in the next work step.

Nevertheless, most production processes require producing tubular bags having a consistent height between the transverse bottom seam and the transverse top seam, respectively. In order to easily attain this constant bag length of all sealed bags, it is intended according to a preferred method variation for the draw speed of the draw device to correspond to a first speed profile when forming a first tubular bag, said draw speed of the draw device corresponding to a second speed profile, which differs from the first speed profile, when producing a directly following second tubular bag. Unlike in conventional production methods for tubular bags, in which the draw speed of the film sheet follows the same speed profile for all tubular bags, the speed profile of the draw speed is alternatingly altered in this preferred method variation. Owing to the speed profile of the draw speed being alternatingly altered, it is possible to compensate the alteration of the minimal distance of the transverse sealing jaws to the fold molding to the extent that the bag length of all sealed bags is essentially consistent.

In this context, it is particularly advantageous if the draw speed, by means of which the film sheet is drawn in the longitudinal direction, is alternatingly altered between a speed maximum and a speed minimum when forming adjacent bags. Via this alteration of the draw speed, it is possible in a particularly easy manner to compensate the alteration of the minimal distance of the transverse sealing jaws to the fold molding to the extent that the bag length of all sealed bags is essentially consistent.

For which kind of tubular bags the method according to the invention is used is generally arbitrary. The method according to the invention is of particular importance when producing tubular bags in which strip-shaped closing elements, which can be detachably engaged with each other, are fastened transversally to the longitudinal axis of the film sheet in the area of the transverse top seam. For in this kind of tubular bag, producing different transverse top seams and transverse bottom seams is imperative if a standing surface is desired in the area of the transverse bottom seam.

BRIEF DESCRIPTION OF THE DRAWING FIGURES

A variation of the method according to the invention is described in the following in an exemplary manner by means of the schematic drawings.

In the following,

DETAILED DESCRIPTION OF THE INVENTION

Figure 1:
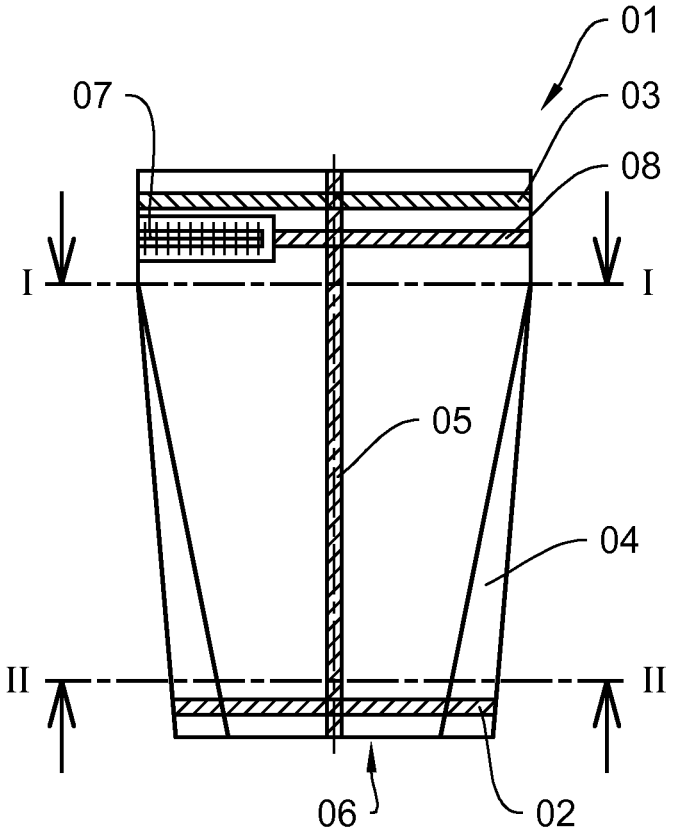
FIG. 1 illustrates a tubular bag having a folded transverse bottom seam and an unfolded transverse top seam in a side view.

In FIG. 1 an exemplary embodiment of a tubular bag 01 produced by means of the method according to the invention is illustrated in a side view. The tubular bag 01 comprises a folded transverse bottom seam 02 and an unfolded transverse top seam 03. To form an infinite longitudinal tube made of a film sheet, the film sheet 04 is longitudinally sealed by means of a longitudinal-seal device along a longitudinal seam 05 before being filled and before producing the transverse seams 02 and 03. Owing to the folded transverse bottom seam 02, a standing surface can be formed at the bottom 06 of the tubular bag 01. In the area of the unfolded transverse top seam 03, i.e. directly beneath the transverse top seam 03, strip-shaped closing elements 07 and 08 can be seen, which can be detachably engaged and enable resealing the opened tubular bag 01 after the user has removed the transverse top seam.

Figure 2:
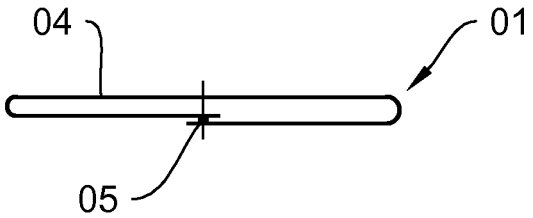
FIG. 2 illustrates the tubular bag according to FIG. 1 in a cross section along the cutting plane I-I.

FIG. 2 illustrates the tubular bag 01 in a cross section along the cutting plane I-I. It can be seen that the tubular bag 01 is not folded in the area beneath the transverse top seam 03.

Figure 3:
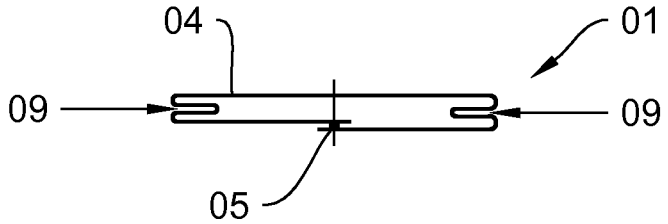
FIG. 3 illustrates the tubular bag according to FIG. 1 in a cross section along the cutting plane II-II.

FIG. 3 illustrates the tubular bag 01 along the cutting plane II-II. In this area, the film sheet 04 is folded at the side at two side folds 09 so as to thus form an at least small standing surface at the bottom 06.

Figure 4:
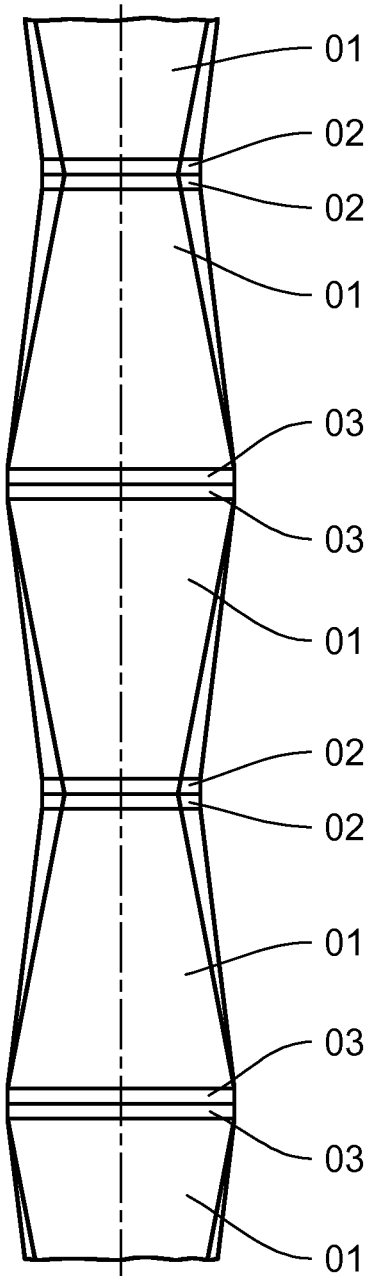
FIG. 4 illustrates a side view of several unseparated tubular bags produced according to method of the invention.

FIG. 4 illustrates several tubular bags 01 produced by means of the method according to the invention, the severing of the individual tubular bags 01 after having been filled and sealed not being illustrated in the illustration according to FIG. 4. The closing elements 07 and 08 are also not illustrated in FIG. 4.

Each adjacent tubular bag 01 is sealed such that either the two adjacent transverse bottom seams 02 are sealed by means of the transverse sealing jaws or, in the next work step, the two adjacent transverse top seams 03 are sealed by means of the transverse sealing jaws. This is necessary in order to alternatingly fold the film tube, which is made of the film sheet 04, at the side, whereupon the transverse bottom seams 02 are sealed, and to forgo folding the film sheet in the respectively following work step and to seal the unfolded transverse top seam 03.

Figure 5:
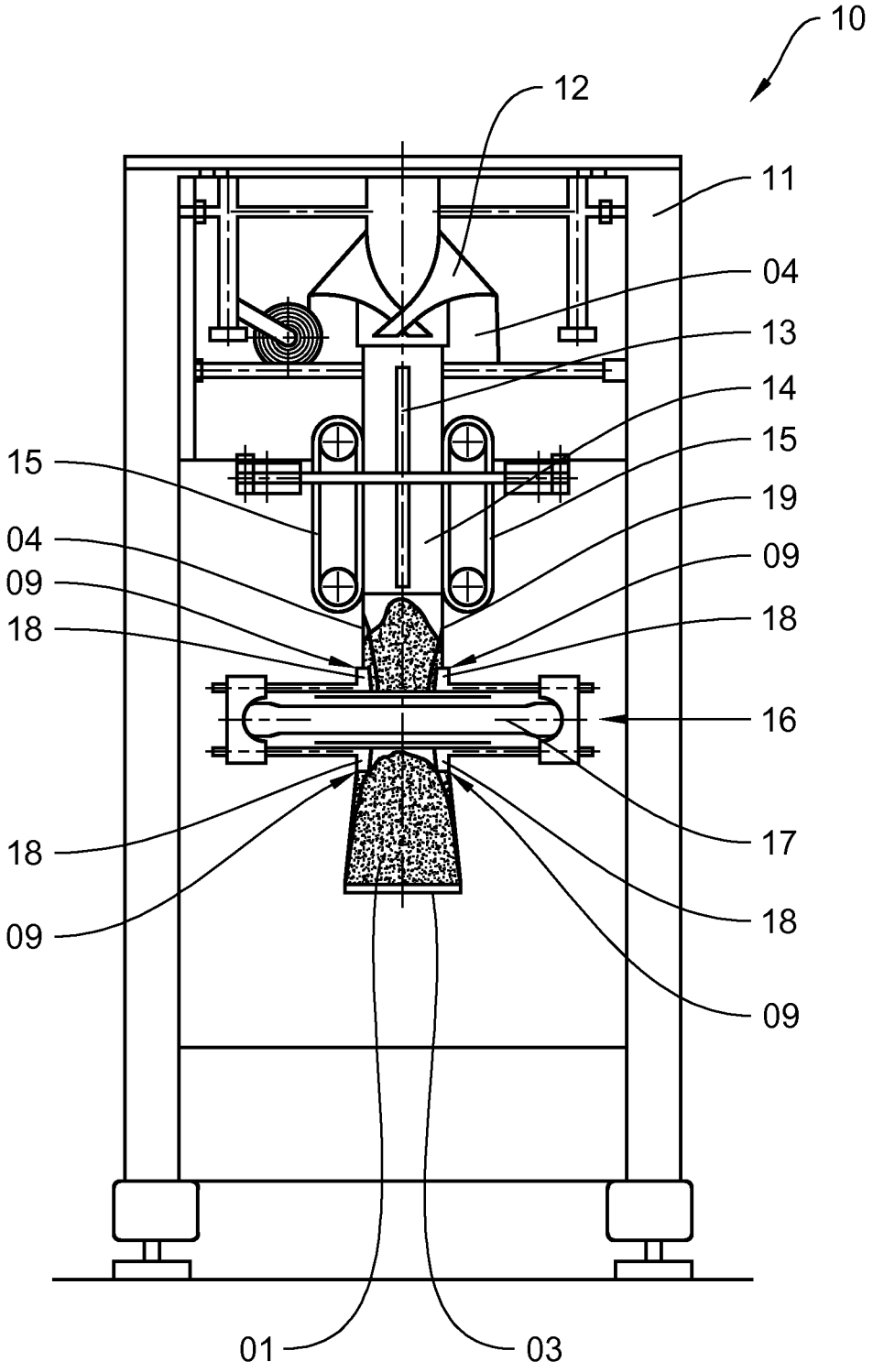
FIG. 5 illustrates a schematic side view of tubular bag machine having biaxially drivable transverse sealing jaw while sealing the two folded transverse bottom seams of two adjacent tubular bags.
Figure 6:
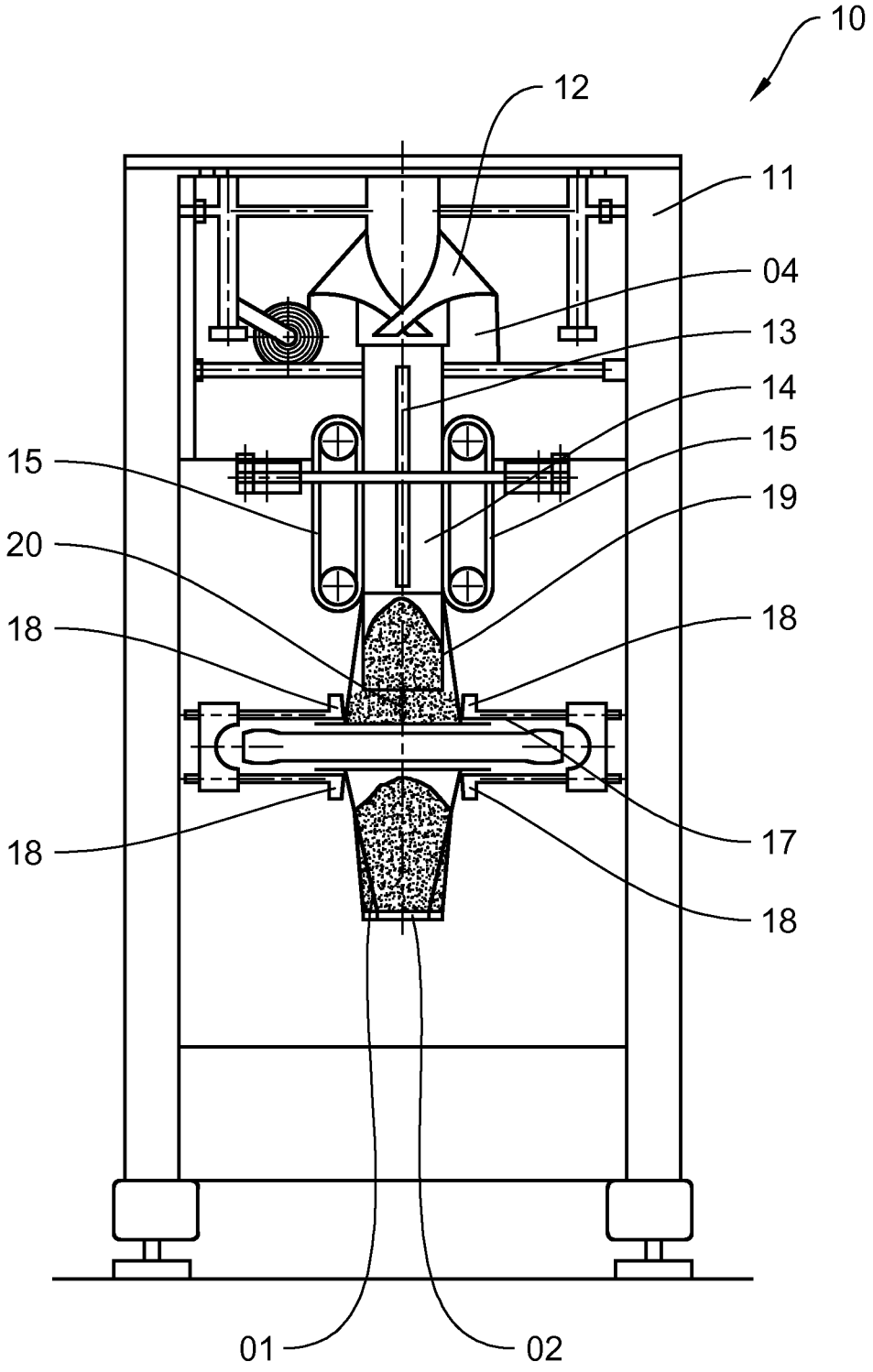
FIG. 6 illustrates the tubular bag machine according to FIG. 5 while sealing the adjacent, unfolded transverse top seams of two adjacent tubular bags in a side view.

The method according to the invention for producing tubular bags 01 is to be further explained by means of the illustration in FIG. 5 and FIG. 6.

The tubular bag machine 10 illustrated in FIG. 5 comprises a frame 11, at whose upper area a mold shoulder 12 is disposed via which the ribbon-like film sheet 04 is conducted for forming a longitudinal tube. In the area of the mold shoulder 12, the film sheet 04 is formed in the longitudinal direction, the outer edges being disposed so as to overlap each other in order to subsequently seal the outer edges to each other upon forming the longitudinal seam 05. The film sheet edges are sealed by means of a longitudinal-seal device 13 which is only schematically illustrated and is disposed on the outer side of a filling tube 14 in the longitudinal direction. Due to the film sheet 04 being folded in the area of the mold shoulder 12 and to the sealing via the longitudinal-seal device 13, a more or less infinite film tube is thus formed which encircles the filling tube 14. The film sheet 04 or rather the infinite tube made thereof is moved downward by means of two draw bands 15, which are driven abutting along the filling tube 14.

Filling material, which exits the filling tube 14 and enters the interior of the film tube, is poured through the filling tube 14 (process not illustrated). A biaxially drivable transverse sealing device 16 is arranged beneath the filling tube 14. The two transverse sealing jaws 17 can be driven in the Z-direction, i.e. in the conveying direction of the tubular bag 01, and towards each other, i.e. transverse to the conveying direction. When sealing the tubular bags 01, the transverse sealing jaws 17 are pressed against each other and the film sheet 04 is sealed via heat exposure. At the same time, the transverse sealing jaws 17 of the transverse sealing device 16 are displaced in the Z-direction in order to follow the conveying movement of the tubular 01 in order to follow the downward conveying direction of the tubular bag 01 from the top.

FIG. 5 illustrates the tubular bag machine 10 when sealing two folded transverse bottom seams, the transverse sealing jaws 17 of the transverse sealing device 16 taking up their highest position in the Z-direction according to the illustration in FIG. 5. For forming the side folds 09 in the area of the transverse bottom seams 02 to be sealed, laterally displaceable side folders 18 are used which are pressed against the film sheet 04 transverse to the conveying direction of the tubular bag 01. In order to realize an ideal fold formation, the two side folders 18 interact with a fold molding 19 disposed on the inner side of the film sheet 04. The fold molding 19 is disposed in the extension of the filling tube 14, the cross section of the fold molding 19 precisely corresponding to the desired fold formation by moving the side folders 18 inward.

In FIG. 6, the tubular bag machine 10 is illustrated during the next work step for forming two unfolded transverse top seams 03. The transverse sealing device 16 takes up its highest point in conjunction with the transverse sealing jaws 17 during its rotation according to the illustration in FIG. 6. It can be seen that the transverse sealing jaws 17 have a larger distance 20 when moving together the sealing of the unfolded transverse top seam 03 with respect to the fold molding 19. Owing to this additional distance 20 of the transverse sealing jaws 17 to the fold molding 19 when commencing the sealing of the two transverse top seams 03, an undesired fold formation in the area of the transverse top seams 03, as otherwise caused by the fold molding 19, is precluded. The side folders 18 are disengaged from the film sheet 04 during the work step for sealing the two transverse top seams 03.

In order to compensate the additional distance 20 when commencing the sealing for producing the two transverse top seams with regard to the bag length, the draw speed of the two draw bands 15 is altered. By altering the draw speed of the draw bands 15, the change in distance, i.e. the alteration of the Z-coordinates of the transverse sealing jaws 17, can be compensated when commencing the sealing of the transverse bottom seams 02 on the one hand and the transverse top seams 03 on the other hand.

The invention claimed is:

1. A method for operating a tubular bag machine (10) having a biaxially drivable transverse sealing device (16) for producing a tubular bag (01), a film sheet (04) being closed by means of a transverse bottom seam (02) and a transverse top seam (03) after having formed a film tube, at least an edge area of the film sheet (04) of the tubular bag (01) being folded so as to form a side fold (09) using a side folder (18), which is transversally moveable to a longitudinal axis of the film sheet (04), before the transverse bottom seam has been formed, and two transverse bottom seams (02) each being formed by adjacent tubular bags (01) in one work step of the transverse sealing device (16), and two transverse top seams (03) each being formed by adjacent tubular bags in one work step of the transverse sealing device (16), and said tubular bags (01) being formed in a draw direction having an alternating orientation, characterized in that the side folder (18) interacts with a stationary fold molding (19) disposed on the inner side of the film sheet (04) when forming the side fold (09) in an area of the transverse bottom seam (02), a minimal distance of the transverse sealing device (16) to a fold molding (19) being alternatingly altered in the draw direction on a closed movement trajectory when forming the transverse top seams and the transverse bottom seams, said minimal distance of the transverse sealing device (16) to the fold molding (19) being larger when producing the two transverse top seams (03) than the minimal distance of the transverse sealing device (16) to the fold molding (19) when producing the transverse bottom seams (02).

2. The method according to claim 1, characterized in that a draw speed of a draw device (15) when forming a first tubular bag (01) corresponds to a first speed profile, said draw speed of the draw device (15) corresponding to a second speed profile different to the first speed profile when forming a directly following second tubular bag.

3. The method according to claim 2, characterized in that the draw speed of the draw device (15), by means of which the film sheet is drawn in the longitudinal direction, is alternatingly altered between a speed maximum and a speed minimum in such a manner that the alternating alteration of the minimal distance of the transverse sealing device (16) to the fold molding (19) is compensated and the tubular bag length of all tubular bags (01) is maintained.

4. The method according to claim 1, characterized in that strip-shaped closing elements (07, 08) detachably engaged with each other, are adapted to be fastened adjacent to the transverse top seam (03) of the tubular bag (01) transversally to the longitudinal axis of the film sheet (04).

5. The method according to claim 2, characterized in that strip-shaped closing elements (07, 08), detachably engaged with each other, are adapted to be fastened adjacent to the transverse top seam (03) of the tubular bag (01) transversally to the longitudinal axis of the film sheet (04).

6. The method according to claim 3, characterized in that strip-shaped closing elements (07, 08), detachably engaged with each other, are adapted to be fastened adjacent to the transverse top seam (03) of the tubular bag (01) transversally to the longitudinal axis of the film sheet (04).

* * * * *